US005421312A

United States Patent [19]

Dawson

[11] Patent Number: 5,421,312

[45] Date of Patent: Jun. 6, 1995

[54] ELECTRICAL CIRCUIT

[75] Inventor: Joseph G. Dawson, Manchester, England

[73] Assignee: Dawson Royalties Limited, Manchester, England

[21] Appl. No.: 50,162

[22] PCT Filed: Nov. 4, 1991

[86] PCT No.: PCT/GB91/01928

§ 371 Date: Apr. 30, 1993

§ 102(e) Date: Apr. 30, 1993

[87] PCT Pub. No.: WO92/08048

PCT Pub. Date: May 14, 1992

[30] Foreign Application Priority Data

Nov. 3, 1990 [GB] United Kingdom ..... 9023943
Nov. 8, 1990 [GB] United Kingdom ..... 9024256
Jun. 8, 1991 [GB] United Kingdom ..... 9112368

[51] Int. Cl.[6] ..... F02P 9/00
[52] U.S. Cl. ..... 123/620; 123/653
[58] Field of Search ..... 123/620, 636, 637, 653

[56] References Cited

U.S. PATENT DOCUMENTS 2,131,018 9/1938 Scott .
4,217,873 8/1980 Nishio et al. ..... 123/653
4,782,242 11/1988 Kovacs ..... 307/106
4,983,882 1/1991 Mayring ..... 315/51
5,168,858 12/1992 Mong ..... 123/620

FOREIGN PATENT DOCUMENTS 0231024 1/1987 European Pat. Off. .
143941 9/1980 Germany ..... 123/653

OTHER PUBLICATIONS

Patent Abstract of Japan, vol. 9, No. 18 (M-353) (1741) Jan. 25, 1985, of JP-A-59-165,870, Sep. 19, 1984, Nippon Denso K.K.
Patent Abstract of Japan, vol. 9, No. 70 (M-367) (1793) Mar. 30, 1985, of JP-A-59-201,978, Nov. 15, 1984, Nippon Denso K.K.

*Primary Examiner*—E. Rollins Cross
*Assistant Examiner*—Thomas Moulis
*Attorney, Agent, or Firm*—William R. Hinds

[57] ABSTRACT

An electrical circuit for connection to a high tension lead which is connected to a spark plug of a spark ignition internal cumbustion engine. The circuit comprises a capacitor (11) the capacitance of which is such that, if a high voltage pulse is applied to the high tension lead, the voltage developed across the capacitor and the charge stored by the capacitor are sufficient to initiate and sustain and ignition spark. The capacitor may be voltage dependent to achieve an optimised spark current characteristic. A resistor (12), such as a voltage dependent resistor, and a voltage controlled discharge device (13) may be connected in parallel with the capacitor.

19 Claims, 7 Drawing Sheets

ELECTRICAL CIRCUIT

The present invention relates to an electrical circuit for use in a spark-ignition internal combustion engine.

In a conventional spark-ignition internal combustion engine, spark plugs are connected to a high voltage supply such as an iginition coil through a distributor. The distributor periodically closes a conductive path between each spark plug and the coil so as to enable a high voltage to be applied across a gap defined by the spark plug. The high voltage is sufficient to generate a spark between the electrodes of the spark plug. The distributor is connected via a single high tension lead to the coil and by respective high tension leads to each of the spark plugs.

A great deal of attention has been paid to optimising spark timing and the conditions within the engine cylinders to which the spark plugs are fitted. Little attention has been given to the nature of the spark itself other than to ensure that the spark is sufficiently large to reliably ignite an air/fuel mixture.

It is an object of the present invention to provide an electrical circuit which enables the spark generated by a ignition coil to substantially enhance the performance of internal combustion engines.

According to the present invention there is provided an electrical circuit for connection to a high tension lead which is connected to a spark plug of a spark ignition internal combustion engine, the circuit comprising a capacitor the capacitance of which is such that, if a high voltage pulse is applied to the high tension lead, the voltage developed across the capacitor and the charge stored by the capacitor are sufficient to initiate and sustain an iginition spark, the capacitor having either a resistor or a voltage controlled discharge device connected in parallel therewith.

Preferably, the capacitor is non-linear, for example voltage dependent such that its capacitance reduces with increases in applied voltage. The capacitor may be temperature dependent such that its capacitance reduces with increases in operating temperature.

The resistor may be non-linear, for example voltage dependent such that its resistance decreases with increases in applied voltage.

In embodiments having a temperature dependent capacitor and a parallel resistor, the resistor may be positioned such that heat generated in the resistor is transferred to the capacitor.

A diode may be connected in series with the capacitor.

A circuit in accordance with the present invention may be connected in series with a spark plug of an internal combustion engine. Where that spark plug is energised from a distributor, the circuit may be connected either between the distributor and the respective spark plug or between a source of electrical energy such as a coil and the distributor.

In a system in which two or more spark plugs are to be energised from one source, then a respective circuit may be connected in series with each spark plug. For example, in an internal combustion engine with two spark plugs per cylinder, this arrangement would circumvent the need for dual ignition drives.

A circuit in accordance with the invention may also be used to enhance spark performance by connecting such a circuit between a high tension lead connected to a spark plug and a source of fixed potential. With such an arrangement a fuse is preferably connected in series with the capacitor such that if the capacitor or any component in parallel with the capacitor fails to a low impedance conductive condition the fuse will burn out and render the circuit ineffective without disabling the spark plug to which it is connected.

Embodiments of the present invention will now be described, by way of example, with reference to the accompanying drawings, in which.

Figure 1:
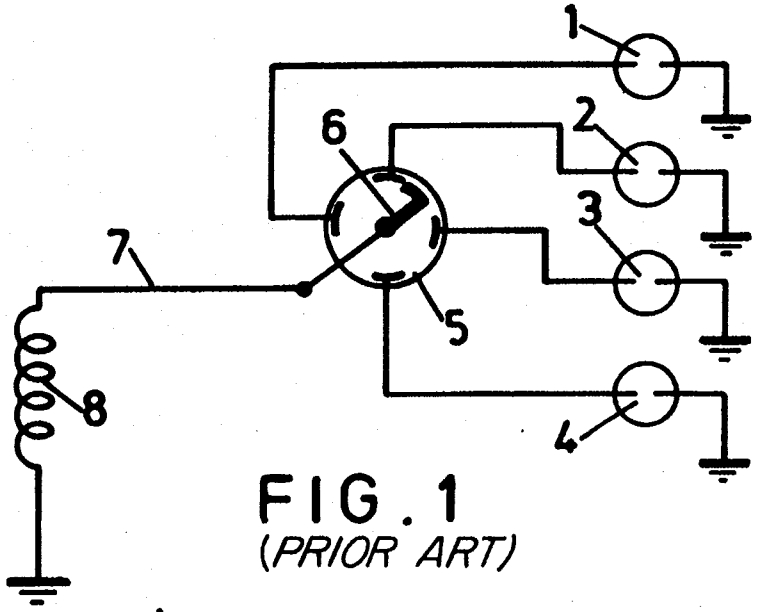
FIG. 1 (PRIOR ART)
FIG. 1 is a schematic illustration of a conventional electrical ignition system for a four cylinder combustion engine.

Referring to FIG. 1, this illustrates the basic components of a conventional coil-energised spark ignition system. Four spark plugs 1 to 4 are connected between a distributor 5 and a source of fixed potential indicated by the earth symbols. The distributor 5 houses a rotor arm 6 driven in synchronism with the engine to which the ignition system is fitted. A high tension lead 7 is connected between the rotor arm and a standard ignition coil winding 8 which in turn is coupled to a source of fixed potential indicated by the earth symbol. Thus when the rotor arm 6 is adjacent a distributor terminal connected to one of the four high tension leads leading to the spark plugs, voltage induced in the coil 8 is supplied to the respective spark plug and a spark is generated.

Figure 2:
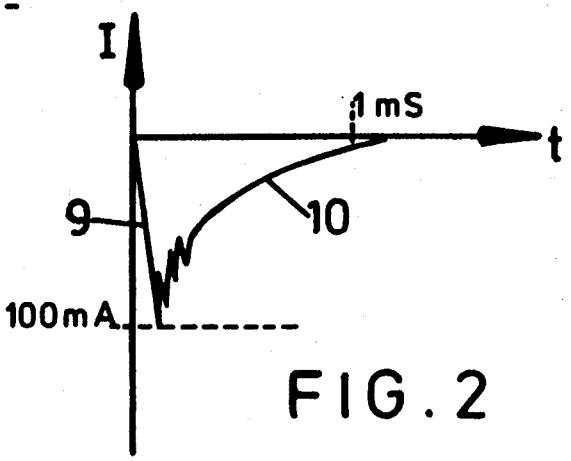
FIG. 2 illustrates a current versus time waveform for a spark generated by a conventional circuit of the type illustrated in FIG. 1.

FIG. 2 illustrates the current versus time relationship for a spark generated by a conventional system such as that illustrated in FIG. 1. There is an initial "brightline" capacitive discharge indicated by the line 9 but the spark terminates with a relatively ineffective inductive flaring portion indicated by line 10.

Figure 3:
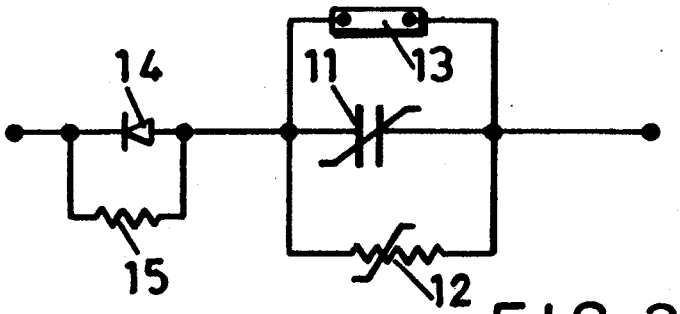
FIG. 3 is a general circuit diagram illustrating components which can be combined in a variety of configurations to form an embodiment of the present invention.

Referring now to FIG. 3, this is a general circuit diagram of a range of components which can be incorporated in a circuit in accordance with the present invention. These components comprise a capacitor 11, a resistor 12 in parallel with the capacitor 11, a voltage control discharge tube 13, a series diode 14 and a parallel resistor 15. The reference numerals 11 to 15 are used throughout the following description where appropriate but it will be appreciated from the following description that the only components which must always be present in any embodiment of the invention are a capacitor 11 and either a resistor 12 or a voltage controlled discharge device 13. Preferably the capacitor 11 is non-linear, having a capacitance which reduces with applied voltage and/or a capacitance which reduces with operating temperature. The resistor 12 may also be non-linear, preferably having a resistance which falls with applied voltage. The discharge tube 13 is provided simply to prevent unduly high voltages being applied to the capacitor 11 and therefore does not normally affect the operation of the circuit. The diode 14 is a normal diode capable of carrying for example 500 mA. The resistor 15 is a simple linear resistor having a resistance of for example 1 Mohm and a rating of 5 watts and 5 kV. The purpose of the circuit illustrated in general form in FIG. 3 is to alter the current versus time waveform from the conventional waveform as shown in FIG. 2 so as to improve the performance of an internal combustion engine to which the circuit is fitted.

Figure 4:
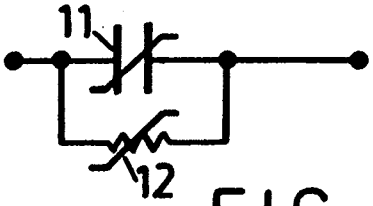
FIG. 4 illustrates an embodiment of the present invention incorporating only two of the components of FIG. 3, that is a capacitor and a parallel resistor.

Referring now to FIG. 4, this illustrates a first embodiment of the present invention. The capacitance of capacitor 11 decreases with the applied voltage. Such characteristics are readily achieved with known ceramic disc capacitors, the relationship between capacitance and applied voltage being represented by a smooth but non-linear curve. In one practical implementation of the circuit of FIG. 4, the capacitance of capacitor 11 was 1000 pF at 0 volts, 600 pF at 6 kV, and 300 pF at 12 kV. The resistor 12 is also voltage dependent, having a resistance at 0 volts effectively of infinity, a resistance at 6 kV at 12 Mohms, and a resistance at 12 kV or 1 Mohm.

Figure 5:
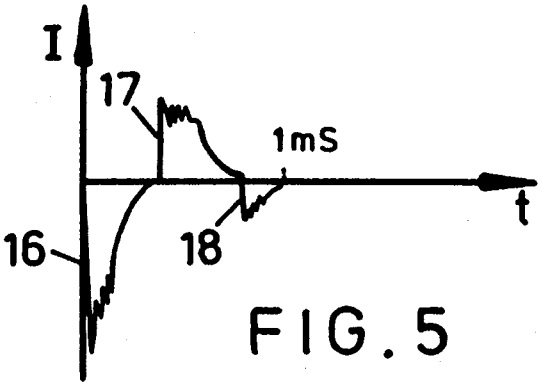
FIG. 5 illustrates a current versus time waveform for a spark generated by a spark plug connected in a conventional ignition system such as that illustrated in FIG. 1 supplemented by a circuit as illustrated in FIG. 4 connected between the coil and distributor.

Referring to FIG. 5, this illustrates the current versus time waveform for a series of sparks generated as a result of introducing the circuit of FIG. 4 between the coil and distributor of a conventional ignition circuit such as that illustrated in FIG. 1. It will be seen that in the illustrated case three brightline sparks are generated each of which can contribute to the efficiency of combustion. The less effective inductive flaring part of the spark shown in FIG. 2 is substantially reduced. Thus with the circuit of FIG. 4 the brightline spark is repeated and alternated. Tests have indicated that the circuit described with reference to FIGS. 4 and 5 aids combustion particularly in the case of lean fuel mixtures.

In greater detail, when the distributor connects the coil to one of the spark splugs through the circuit of FIG. 4, a primary winding (not shown) of the coil is broken by a conventional mechanism within the distributor and a negative voltage spike of several thousand volts is transmitted through the capacitor 11 to the spark plug. When the magnitude of this voltage has risen sufficiently the gap defined by the spark plug is ionised sufficiently for a spark to be formed. Current then flows from the earth terminal of the spark plug through the circuit of FIG. 11, the distributor 5 and the coil 8 to earth. This current flow is indicated in FIG. 5 by the sharp negative current flow represented by line 16 and initiated shortly after the start of the current versus time plot.

The current which passes through the capacitor 11 causes a voltage to be developed across the capacitor. As this voltage rises, the current delivered to the spark plug falls and eventually the voltage developed across the coil 8 is not sufficient to sustain a spark in the spark plug gap. Thus the current fails to zero. Once this has occurred, the combined reverse bias voltage of the coil 8 and the capacitor 11 is sufficient to re-ionise the gap defined by the spark plug but this time in the opposite direction. The capacitor then disharges through the spark gap and this is indicated in FIG. 5 by the line 17. Thus the spark plug is alternatively ionised in one direction and then in the other and spark current flows in each of these directions.

Depending upon the engine configuration, the coil, the spark plug gaps, and the capacitance value of the capacitor 11, the current may cease after one spark in each direction or more cycles of operation may be sustained.

The resistor 12 has a resistance value sufficiently high as to have little impact on the united magnitude of the current flowing to the spark plug. The resistor 12 could have a stable rsistance, in which case its purpose is simply to discharge the capacitor of any residual charge between successive energisations of the spark plugs. It is however possible to simply dispense with the resistor 10. Results achieved with a simple capacitor circuit with no parallel resistor are described below. It is however preferred to provide the resistor 12 such that its resistance falls with applied voltage.

In the event of a malfunction with the circuit of FIG. 4 the voltage across the capacitor 11 can build up to such a high level that the capacitor can break down and fail to a low impedance condition. This does not prevent the circuit continuing to operate in a conventional manner, that is to say as if the capacitor 11 and resistor 12 were absent, but does make the circuit formed by capacitor 11 and resistor 12 inoperative. To prevent such a high voltage malfunction occurring it is possible to supplements the circuit as described below by connecting a threshold voltage discharge device 13 in parallel with the capacitor 11. The discharge device 13 will be rated to break down at a voltage above the normal operating voltage of the capacitor but below a voltage at which damage to the capacitor could occur. Thus generally the discharge device 13 will be inoperative but it is there to protect the capacitor 11 if circumstances arise in which unduly high voltages are generated in the coil. The discharge device 13 would be provided as an alternative to or in addition to the provision of a non-linear resistor such as a varistor in parallel with the capacitor. Varistors are available the resistance of which falls linearly with applied voltage for voltages of a few thousand volts and the resistance of which falls rapidly at higher voltages, e.g. 12 Kv.

The capacitor 11 of FIG. 4 exhibits a large capacitance to the brightline edges but its non-linearity with respect to voltage ensures that it shuts down the less effective inductive flaring components. The resistor 12 protects the capacitor against overcharging. The effective capacitance exhibited by the circuit determines the frequency of the brightline edges such that:

$$\text{frequency} = 1/[2\pi\sqrt{LC}]$$

where L is the inductance of the high tension coil and C is the effective capacitance of the circuit.

The circuit of FIG. 4 can be used on all conventional vehicles subject to its use not disrupting other control mechanisms. For example in vehicles with engine speed counting mechanisms associated with the ignition system, the multiple AC sparks per ignition cycle could disrupt the engine speed monitoring circuits.

Figure 6:
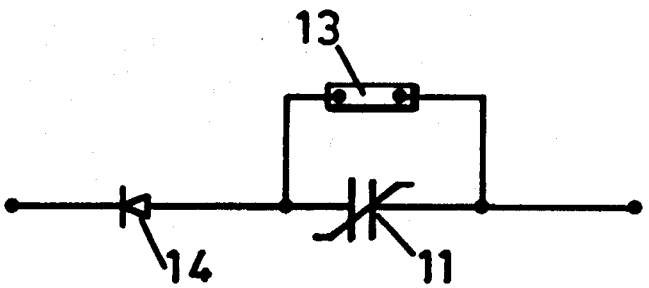
FIG. 6 illustrates a second circuit in accordance with the present invention.
Figure 7:
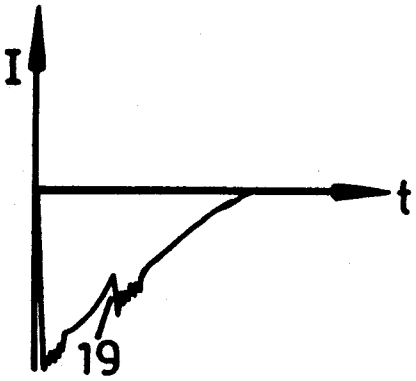
FIG. 7 illustrates a current versus time waveform for a spark generated using the circuit of FIG. 6.

Referring now to FIG. 6, this illustrates a further embodiment of the present invention in which the capacitor 11 is in parallel with a discharge tube 13 and in series with a diode 14. FIG. 7 illustrates the curent versus time spark waveform assuming that the circuit of FIG. 6 is incorporated in a conventional ignition system either between the coil and the distributor or in each of the high tension leads leading from the distributor to the spark plugs.

The diodie 14 ensures that the circuit retains a DC spark. It produces an "echo" brightline discharge to improve the ignition properties. The echo discharge is indicated by line 19 in FIG. 7. Again, the capacitor 11 is voltage dependent to pass the brightline edge but also to reduce inductive flaring components. The circuit of FIG. 6 can be used with any engine speed counting mechanism as the spark remains DC. The circuit of FIG. 6 is suitable for use in lean burn engines.

Figure 8:
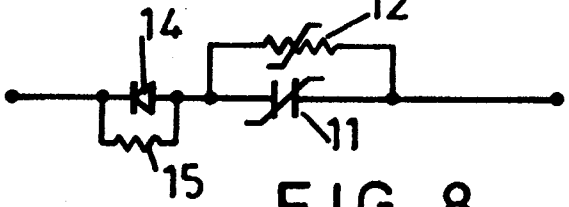
FIG. 8 illustrates a further circuit in accordance with the present invention.

Referring now to FIG. 8, this illustrates an embodiment of the present invention which is capable of reducing cyclical dispersions using static charge retention. The circuit of FIG. 8 comprises capacitor 11, resistor 12, diode 14 and resistor 15.

Cyclic spark ignition dispersion is caused as a result of the spark not being of the correct intensity and duration given a particular engine speed. Accordingly cyclic dispersion can be reduced by decreasing the spark intensity and duration at high engine speeds.

Figure 9:
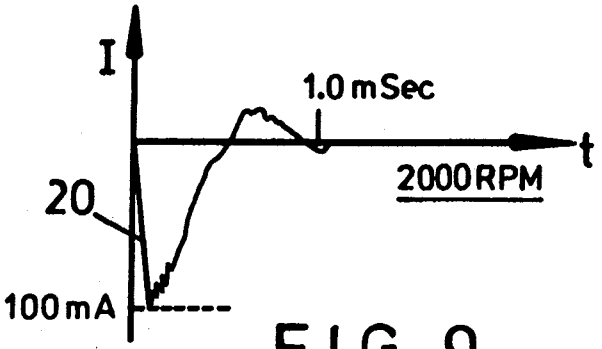
FIGS. 9 and 10 represent current versus time curves for sparks generated using the circuit of FIG. 8 but at different engine speeds.
Figure 10:
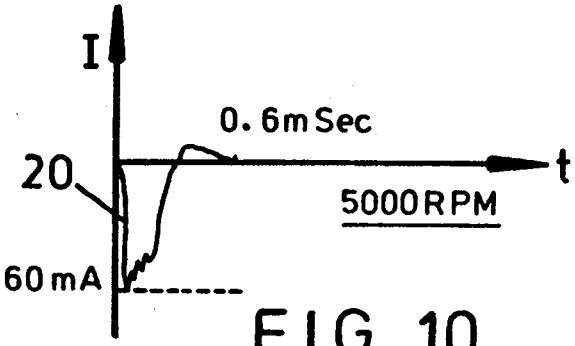
Figure 11:
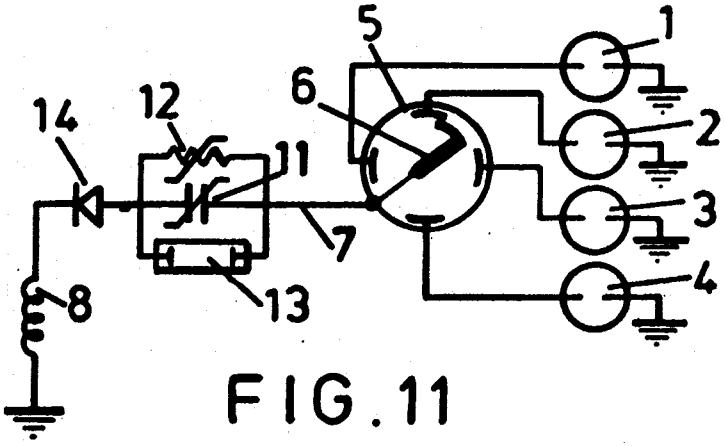
FIG. 11 illustrates a further embodiment of the present invention incorporated in a circuit of the type illustrated in FIG. 1.

FIGS. 10 and 11 illustrate spark waveforms achieved by incorporating the circuit of FIG. 8 in a conventional ignition system. FIG. 9 showing the results at 2000 rpm and FIG. 10 showing the results at 5000 rpm. As can be seen from FIGS. 9 and 10, the maximum spark current decreases with increasing rpm as does the spark duration. The diode 14 does not affect the first brightline edge indicated by line 20. The resistor 15 decreases the rate of discharge of the capacitor 11 such that at high rpm the capacitor 11 cannot fully discharge. The small positive currents indicated in FIGS. 9 and 10 result from current passing through the resistor. The capacitor 11 thus retains a static charge which is proportional to rpm. This acts as a barrier to the next spark and therefore reduces its intensity. Thus the circuit matches the spark shape, intensity and duration to engine speed.

Referring now to FIG. 11, this illustrates a further embodiment of the present invention incorporated in an otherwise conventional ignition system of the type shown in FIG. 1. In the case of the circuit of FIG. 11, however, the resistor 12 is mounted physically close to the capacitor 11 so that the energy dissipated in the resistor 12 can be used to increase the temperature of the capacitor 11. The capacitor has a capacitance which decreases with temperature. Again conventional ceramic disc capacitors are well known which exhibits such characteristics.

With such an arrangement, the capacitance of the capacitor 11 reduces as the power dissipation increases with engine speed, that power dissipation increasing with engine speed. As the capacitance reduces, then so does the amplitude and duration of the spark. Thus as engine speed increases the spark size reduces, and cyclic dispersion is reduced as a result of the temperature modulation of the non-linear capacitor. On the other hand, at lower temperatures the spark amplitude is increased which is also beneficial.

With the arrangement of FIG. 11 it is necessary to mount the capacitor 11 and resistor 12 on a heat sinking structure. Power dissipation in the resistor 12 is typically from 2 to 12 watts. The capacitor 11 can be arranged to change in capacitance from 1000 pF to 300 pF over a temperature range of the order of 100° C.

The circuit of FIG. 11 incorporates a series diode 14 which enables only DC spark generation. This can be advantageous under certain circumstances, for example in the case of well maintained and well tuned engines. This approach reduces the temperature of the spark plug and the rate of carbon disposition on the plug by reducing the length and magnitude of the current waveform.

Thus the described circuits enable spark ionisation distribution in time and space to be optimised. The circuits can be fitted as original equipment or retrofitted to existing ignition systems. Cyclic dispersion in firing cycles at different engine speeds can be reduced. This can lead to improved power, reduced emissions and reduced predetonation, engine knocks and pinking.

The components can be fabricated from conventional material. For example non-linear resistors can be fabricated using silicon carbide (SiC). Capacitors can be fabricated using conventional ceramic material such as barium titanate.

Figure 12:
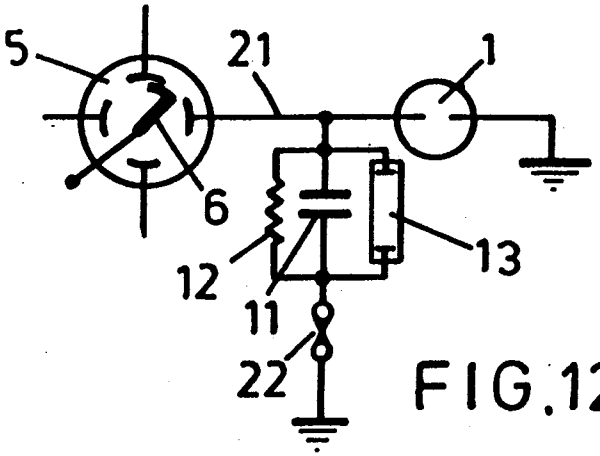
FIG. 12 illustrates an embodiment of the present invention incorporated in a conventional circuit but in a different configuration to that of FIG. 11.

In the arrangements described with reference to FIGS. 1 to 11, the circuit of the invention is connected in series with one or more of the spark plugs. The circuit is also applicable as an enhancer of conventional DC sparks in a configuration such as that shown in FIG. 12, in which the same reference numerals are used where appropriate. In FIG. 12, the high tension supply 8, lead 7 and the plugs 2, 3 and 4 are omitted to simplify the illustration. As shown, the capacitor 11, resistor 12 and discharge device 13 are connected in parallel between a high tension lead 21 connecting the plug 1 to the distributor 5 and a fuse 22 which is connected to ground. With this arrangement, when the coil primary is broken the current initially flows through the capacitor 11 from ground until voltage builds up across the capacitor. The voltage builds up to a sufficient level to cause the plug 1 to spark and thereafter the charge on the capacitor 11 sustains the spark such that the magnitude and duration of the DC spark is enhanced.

In the arrangement of FIG. 12, if the resistor or capacitor 11 were to fail to a low impedance condition, the spark plug 1 would be in effect short circuited and would be inoperative. If this was to happen however such a high current would be drawn through the fuse as to exceed its rating and as a result the fuse 22 would burn out. The circuit formed by components 11, 12 and 13 would then be inoperative and the system would again continue to operate in a conventional manner. Thus the system fails safe in an operative condition.

Figure 13:
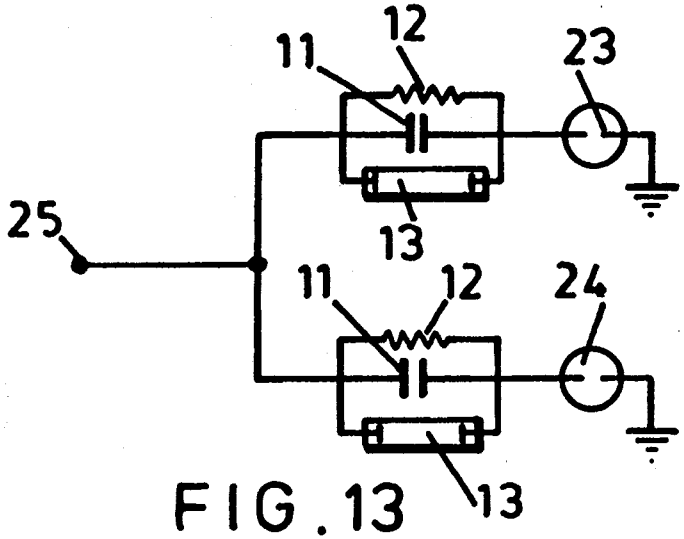
FIG. 13 illustrates an embodiment of the present invention used to generate two substantially simultaneous sparks in a cylinder provided with two spark splugs.

Referring now to FIG. 13, this illustrates a further application of the circuit shown in FIG. 12. In the arrangement of FIG. 13 two plugs 23 and 24 are positioned in the same cylinder of an internal combustion engine and are intended to fire simultaneously. Such twin plug arrangements are well known. Each of the plugs 23 and 24 is connected to a high tension lead terminal 25 via a respective circuit, each of the two circuits comprising a capacitor 11, a resistor 12 and a discharge device 13. Again when the coil primary is broken, current initially flows through the capacitors 11 to cause the plugs 23 and 24 to fire. This arrangement also facilitates the possibility of out of phase sparks. A reverse spark is then induced as a result of charge building up on the capacitors 11. This arrangement ensures that both plugs fire reliably and there is no tendency for the firing of one plug to disable the firing of the other. Further charge storage could also be achieved by connecting a further circuit of the type illustrated in series with the high tension lead connected to the terminal 25.

In the arrangement of FIG. 13, a diode could again be connected between the terminal 15 and each of the circuits but this would produce uni-directional current through the plugs.

Figure 14:
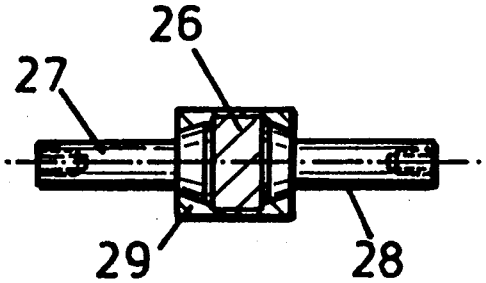
FIG. 14 illustrates the structure of a capacitor suitable for use in embodiments of the present invention.

FIG. 14 illustrates the structure of one ceramic disc capacitor having appropriate temperature and voltage characteristics. The capacitor comprises a disc 26 of barium titanate secured between two terminals 27 and 28 by a resin casing 29. Such a capacitor will typically have an outer diameter of 16.5 mm and an axial thickness of 10 mm. The capacitor having the dimensions illustrated in FIG. 14 has a capacitance at 12 kV or 380 picofarads.

Initial tests have conducted to assess the effect of connecting circuits in accordance with the present invention in conventional ignition systems. The results of these tests are set out in FIGS. 15 to 21. In each of the test cases, the circuit was in the form of a simple ceramic disc capacitor connected between a conventional ignition coil and a conventional distributor. The capacitor in each case was applied voltage dependent.

Figure 15:
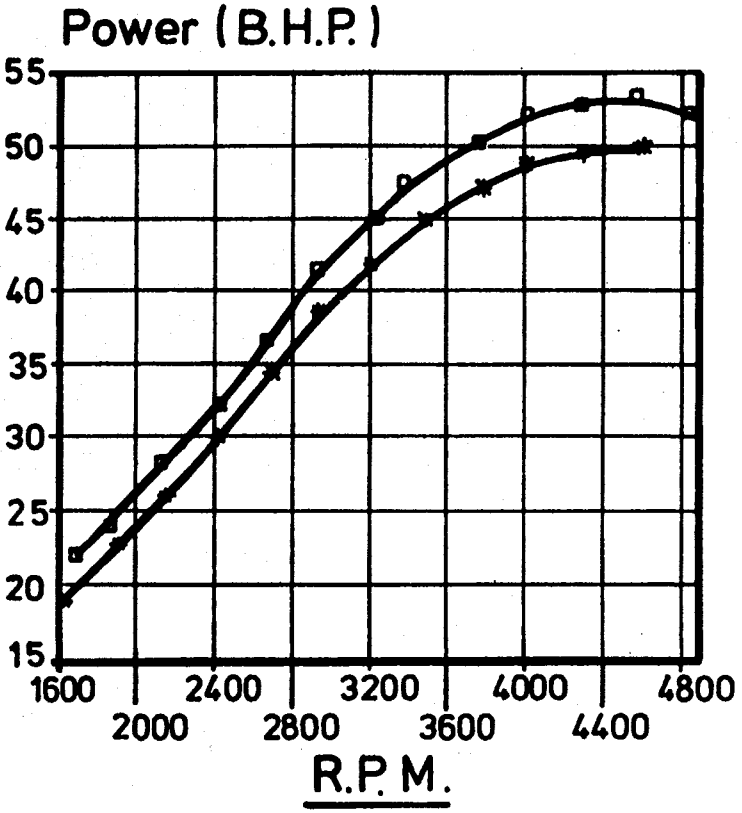

Referring to FIG. 15, this shows the relationship between engine speed and power output for a Ford Sierra car. The lower curve represents the results with an unmodified ignition system and the upper curve represents the results of fitting a capacitor in series with the coil output, the capacitor having a capacitance of 1000 picofarads at zero applied volts.

Figure 16:
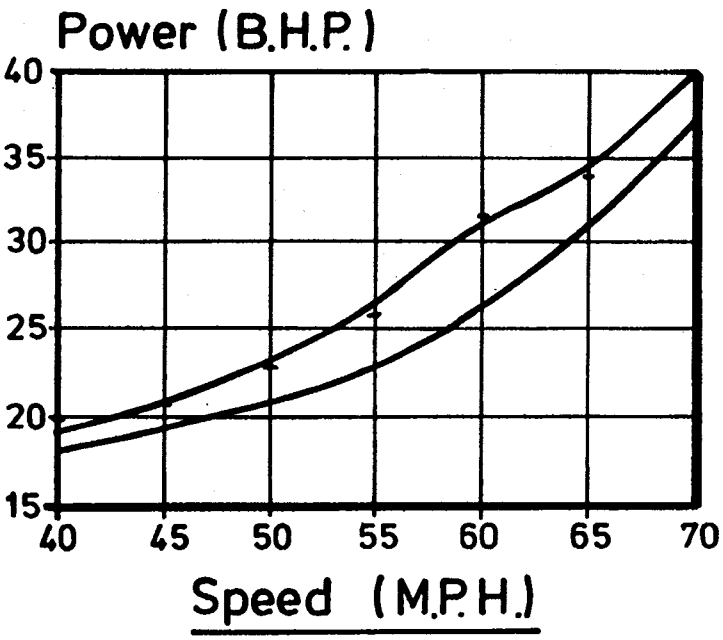
FIGS. 15 to 19 illustrate the effect on output power of fitting a circuit in accordance with the present invention to a conventional ignition system.

Referring to FIG. 16, this illustrates results obtained with a Citroen Visa vehicle running on a rolling road. Engine speed is represented by vehicle speed. The lower curve shows the results of an unmodified ignition system and the upper curve shows the results with a modified ignition system, a voltage dependent capacitor being connected in series with the output of the ignition coil and a resistor being connected in parallel with the capacitor. The capacitor had a capacitance of 500 picofarads at zero applied voltage and the resistor has a resistance of 5 Mohms at zero applied voltage.

Figure 17:
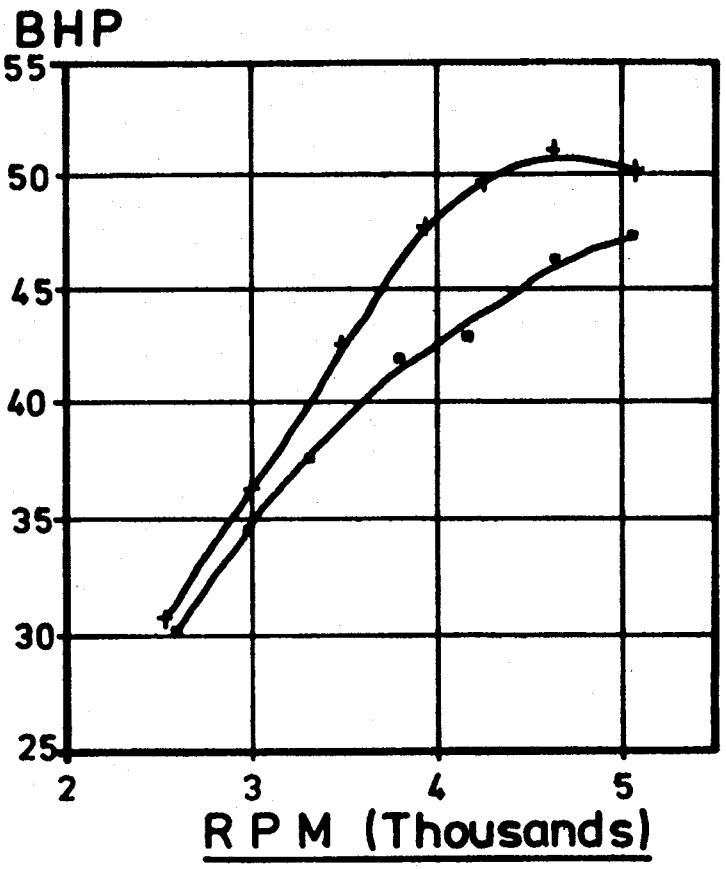

Referring to FIG. 17, this illustrates the relationship between power and engine speed in the case of a 1986 Renualt 11 GLS. Again the circuit used was a simple capacitor in series with the coil output. The lower curve shows results before the circuit was modified and the upper curve shows results after modification.

Figure 18:
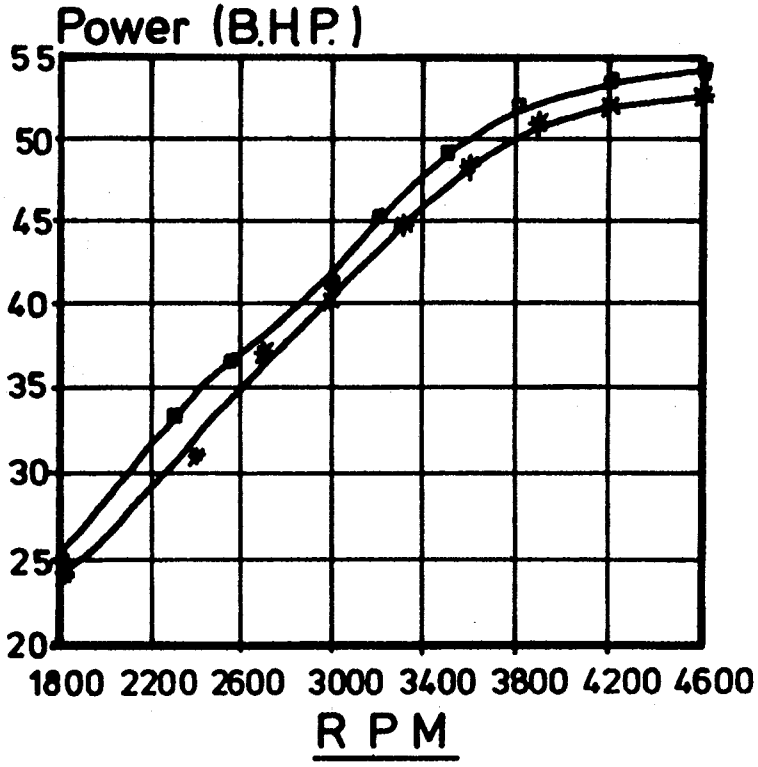

FIG. 18 shows the results obtained with a Vauxhall Astra car. The lower curve indicates performance with an unmodified ignition system and the upper curve shows the effect of connecting a capacitor in series with the coil output. The capacitor used has a capacitance of 1000 Pf at zero applied volts.

Figure 19:
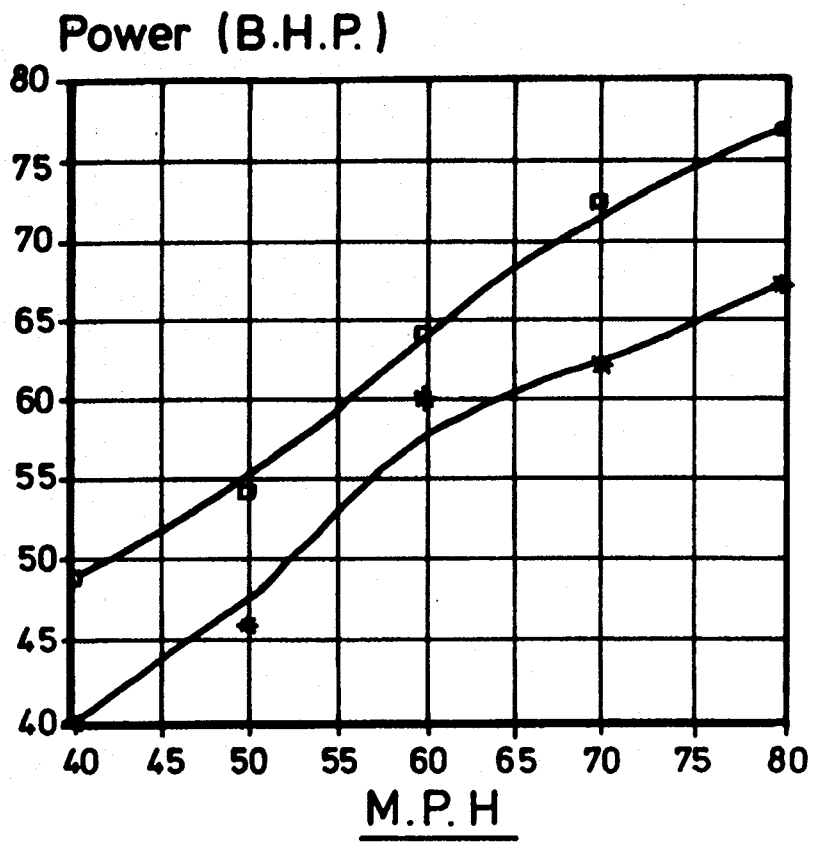

FIG. 19 illustrates results obtained on a rolling road for a For Ganada car. The lowr curve indicated power with an unmodified ignition system and the upper curve indicates power after a voltage dependent capacitor was connected in series with the coil output. The capacitor had a capacitance of 1000 pF at zero applied volts.

Figure 20:
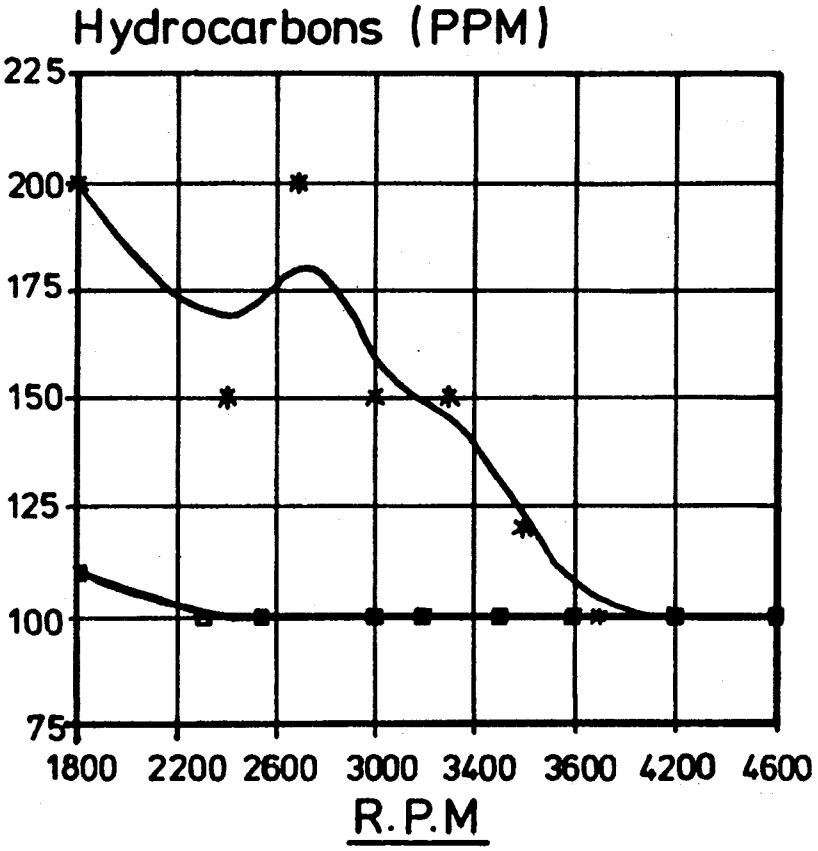
FIG. 20 illustrates the effect on hydrocarbon output of fitting a circuit in accordance with the present invention to a conventional ignition system.

FIG. 20 illustrates the effects on hydrocarbon emissions. The upper curve indicates emissions with an unmodified ignition system and the lower curve indicates emissions after a capacitor was connected in series with the vehicle coiled output. The capacitor used had a capacitance of 1000 PF at zero applied volts.

Figure 21:
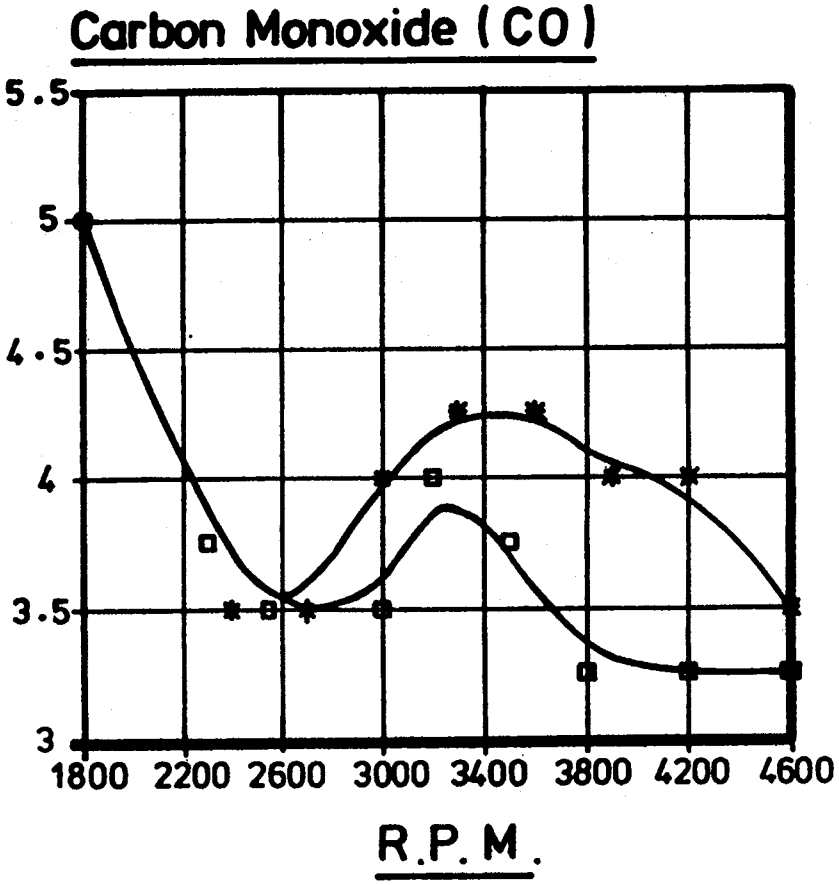
FIG. 21 illustrates the effect on carbon monoxide output of fitting a circuit in accordance with the present invention to a conventional ignition system.

FIG. 21 shows the effects on carbon monoxide emissions resulting form the same vehicle and the same circuit modification as generated the results of FIG. 20. The lower curve represents emissions with a modified circuit and the upper curve emissions with the unmodified circuit. The results of FIGS. 20 and 21 were obtained from a conventional Vauxhall Astra.

Thus, tests have shown that circuits as described with references to the accompanying drawings operate in a particularly efficient manner to provide improved combustion. These improved performance characteristics arise from the circuit providing enhance brightline capacitive discharge components of continuous rising and decaying edges and more advantageous current waveforms. With circuits not incorporating a diode, ions impact both plug electrodes thereby maintaining clean spark plugs. AC excitation also produces better ionisation. This leads to better start up ignition. Where there are multiple capacitive rising surrent edges this will help ignite leaner fuel mixtures. Thus overall better combustion characteristics can be achieved giving improved engine cleanliness, reduced emissions and improved engine efficiency. By suitable pulse shaping, the circuit may also be used to produce current waveforms which lead to a substantial reduction in radio frequency interference emissions.

In summary, the invention can provide benefits including:

1. A high voltage circuit which produces a dual polarity spark from a conventional single polarity high tension coil source.
2. A high voltage circuit which enlarges brightline capacitive components of a single polarity spark produced from a conventional high tension source.
3. A high voltage circuit which produces simultaneous twin, single or dual polarity sparks from a conventional single polarity high tension source to drive two spark plugs per cylinder arrangement without the need for dual ignition systems.

I claim:

1. An electrical circuit for connection to a high tension lead which is connected to a spark plug of a spark ignition internal combustion engine, the circuit comprising a capacitor, the capacitance of said capacitor when employed along being such that if a high voltage pulse is applied to the high tension lead, the voltage developed across the capacitor and the charge stored by the capacitor are sufficient to initiate and sustain an ignition spark, wherein there is a resistor connected in parallel with said capacitor.

2. An electrical circuit for connection to a high tension lead which is connected to a spark plug of a spark ignition internal combustion engine, the circuit comprising a capacitor, the capacitance of said capacitor when employed alone being such that if a high voltage pulse is applied to the high tention lead, the voltage developed across the capacitor and the charge stored by the capacitor are sufficient to initiate and sustain an ignition spark, wherein there is a voltage controlled discharge device connected in parallel with said capacitor.

3. An electrical circuit according to claim 1, wherein the capacitor is non-linear.

4. An electrical circuit according to claim 1, wherein the capacitor is voltage dependent such that its capacitance reduces with increases in applied voltage.

5. An electrical circuit according to claim 1, wherein the capacitor is temperature dependent such that its capacitance reduces with increases in operating temperatures.

6. An electrical circuit according to claim 1, wherein the capacitor is fabricated from a ceramic material.

7. An electrical circuit according to claim 6, wherein the ceramic material is barium titanate.

8. An electrical circuit according to claim 1, wherein the resistor is non-linear.

9. An electrical circuit according to claim 8, wherein the resistor is voltage dependent such that its resistance decreases with increases in applied voltaged.

10. An electrical circuit according to claim 5, wherein the resistor is positioned such that heat generated in the resistor is transferred to the capacitor.

11. An electrical circuit according to claim 1, wherein the resistor is fabricated from silicon carbide.

12. An electrical circuit according to claim 2, wherein the voltage controlled discharge device is a discharge tube.

13. An electrical circuit according to claim 1, comprising a diode connected in series with the capacitor.

14. An electrical circuit according to claim 1, wherein said circuit is for connection in series with a spark plug.

15. An electrical circuit according to claim 14, wherein the circuit is connected between a high voltage pulse source and a distributor, a plurality of spark plugs being connected to the distributor.

16. An electrical circuit according to claim 1, wherein said circuit is for connection between a source of fixed potential and a high tension lead in series with a spark plug.

17. An electrical circuit according to claim 16, wherein a fuse is connected in series with the capacitor, the fuse being rated to burn out if the capacitor fails to a low impedance conductive condition.

18. An electrical circuit according to claim 1, wherein a first said circuit is connected in series with a first spark plug and a second said circuit is connected in series with a second spark plug, the series connected first circuit and spark plug and the series connected second circuit and spark plug being connected in parallel between a high tension lead and a source of fixed potential.

19. An electrical circuit according to claim 18, wherein there is a diode connected in a high tension lead to which each of the said series of connected circuits is connected.

* * * * *